United States Patent [19]

Boyden

[11] 3,944,052

[45]*Mar. 16, 1976

[54] SINGLE ELEMENT FLEXIBLE TYPE DRUM

[75] Inventor: Robert E. Boyden, Temple City, Calif.

[73] Assignee: Thomas B. O'Reilly, Santa Barbara, Calif.

[ * ] Notice: The portion of the term of this patent subsequent to Dec. 25, 1990, has been disclaimed.

[22] Filed: Sept. 17, 1973

[21] Appl. No.: 397,954

Related U.S. Application Data

[63] Continuation-in-part of Ser. No. 69,542, Sept. 4, 1970, Pat. No. 3,780,845, and a continuation-in-part of Ser. No. 304,365, Nov. 7, 1972.

[52] U.S. Cl. ..... 197/53; 197/187

[51] Int. Cl.[2] ..... B41J 1/46

[58] Field of Search ..... 197/54, 46, 53, 55, 52, 197/48, 18, 16, 187, 49; 178/34

[56] References Cited

UNITED STATES PATENTS

| | | | |
|---|---|---|---|
| 317,371 | 5/1885 | Kaley | 197/54 |
| 543,164 | 7/1895 | Weiss | 197/52 X |
| 1,328,158 | 1/1920 | Kousnetzoff et al. | 197/46 |
| 3,175,671 | 3/1965 | Lapointe et al. | 197/18 X |
| 3,247,941 | 4/1966 | Beattie et al. | 197/55 |
| 3,295,652 | 1/1967 | Sasaki | 197/53 |
| 3,307,672 | 3/1967 | Young | 197/53 X |
| 3,640,369 | 2/1972 | Rolph | 197/54 |
| 3,651,916 | 3/1972 | Becchi | 197/54 |
| 3,780,845 | 12/1973 | Boyden | 197/53 X |

FOREIGN PATENTS OR APPLICATIONS

| | | | |
|---|---|---|---|
| 1,575,348 | 7/1969 | France | 197/48 |

*Primary Examiner*—Clifford D. Crowder
*Attorney, Agent, or Firm*—Finnegan, Henderson, Farabow & Garrett

[57] ABSTRACT

A type drum comprising a shell formed as an open network of rows and columns with type characters being formed at the intersections thereof, the shell being attached at one end by struts to a hub located within the shell and spaced therefrom and a combination of the type drum and structure for releasably mounting the drum onto a support such that the drum may rotate relative to its support.

33 Claims, 6 Drawing Figures

SINGLE ELEMENT FLEXIBLE TYPE DRUM

BACKGROUND OF THE INVENTION

This application is a continuation-in-part of copending patent application Ser. No. 69,542 filed Sept. 4, 1970, now U.S. Pat. No. 3,780,845, and entitled Power Driven Typewriter With Single Type Head and copending patent application Ser. No. 304,365 filed Nov. 7, 1972 entitled Power Driven Typewriter.

This invention relates to typewriters and has particular reference to a power driven typewriter having a rotatable and axially movable type drum formed with a plurality of axially spaced circumferential rows of type characters. The drum is movable coordinately under control of different type keys to locate a selected type character at a printing point.

Single element typewriter print heads or drums have been widely used for many years. Perhaps the best known drum of this type is the element used on a typewriter known as the IBM Selectric, which drum is rigid and has a generally spherical configuration with the full alphanumeric font formed on the surface thereof. Such a drum is expensive to produce and requires a heavy-duty operating mechanism in order to produce accurate printing which is not adversely affected by inertia and momentum of the element.

Accordingly, it is an objective of this invention to provide a type head or drum having a reduced inertia and momentum and which can be manufactured and installed at minimal cost.

It is another objective of this invention to provide a type drum of the rotatable and axially movable type which permits reduction in the number and cost of operating elements employed in the operation of the type drum while providing improved accuracy of typing and consistent printing impressions from all type characters on the drum.

Additional objectives and advantages of the invention will be set forth in part in the description which follows, and in part will be obvious from the description, or may be learned by the practice of the invention. The objectives and advantages of the invention may be realized and obtained by means of the instrumentalities and combinations particularly pointed out in the appended claims.

BRIEF DESCRIPTION

To achieve the foregoing objectives and in accordance with the purpose of the invention, as embodied and broadly described herein, the type drum comprises a cylindrical shell formed of an open network of a plurality of axially spaced apart circumferential rows and a plurality of circumferentially spaced apart resilient longitudinal columns intersecting said rows, a type character being located on at least the majority of the intersections of said rows and said columns. Preferably the drum further includes a hub within the shell and spaced therefrom, the hub having means for mounting the drum on a drum support and connecting the drum and hub.

It is also preferred that the shell is an integral molded structure having the type characters molded thereon and that the hub and connecting means for attaching the shell and the hub is an integral molded structure.

The invention consists in the novel parts, constructions, arrangements, combinations and improvements shown and described. The accompanying drawings, which are incorporated in and constitute a part of this specification, illustrate one embodiment of the invention and, together with the description, serve to explain the principles of the invention.

DETAILED DESCRIPTION

Figure 1:
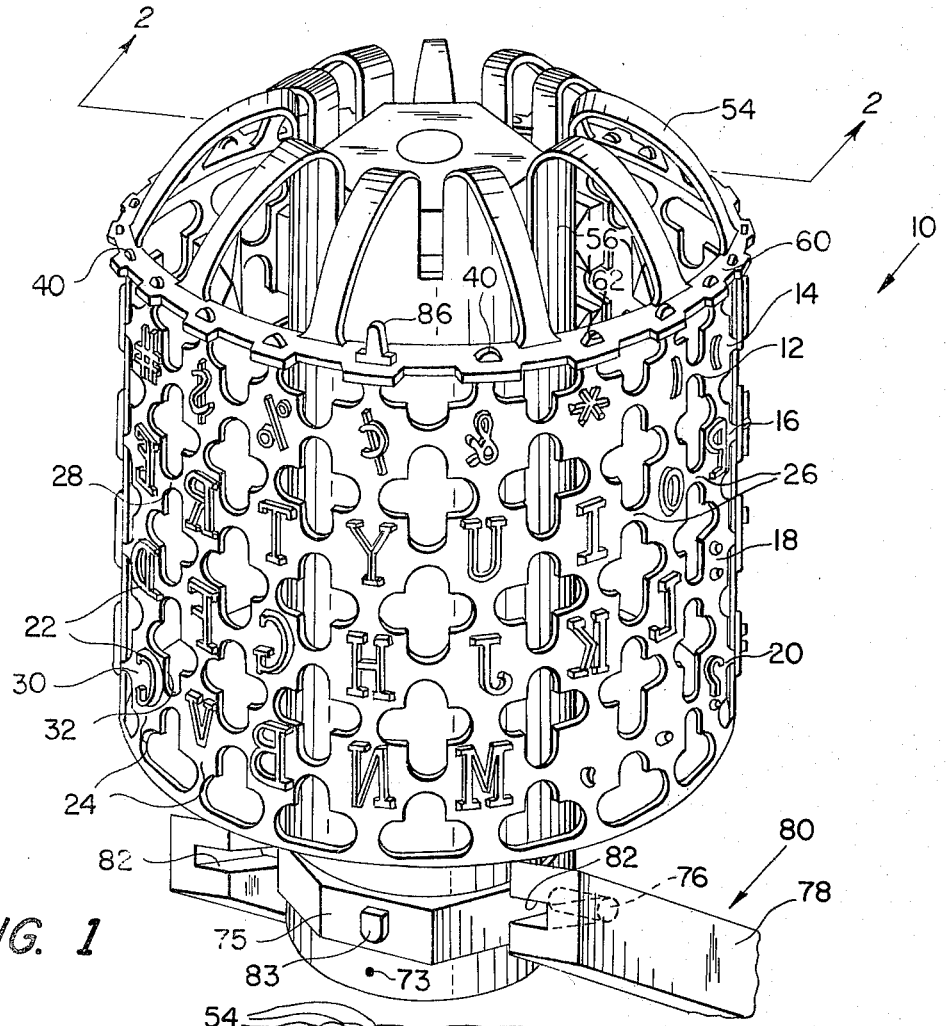
FIG. 1 is a perspective view of a type drum formed in accordance with this invention.

Reference will now be made in detail to the present preferred embodiment of the invention, an example of which is illustrated in the accompanying drawings.

In accordance with the invention, a type drum 10 is provided which includes a cylindrical shell 12 having a plurality of circumferential rows 14, 16, 18, 20 spaced apart in an axial direction. Each of the rows are provided with a plurality of circumferentially spaced apart type characters 22 on the exterior surface thereof. Preferably the type characters 22 are aligned along longitudinal columns 24 spaced apart circumferentially. While the number of rows and columns may be varied and will depend upon the particular font provided on the exterior surface of the type drum 10, one particular form of drum which may be used with a conventional typewriter font includes 88 different characters and can be provided with four rows and 22 columns.

Figure 2:
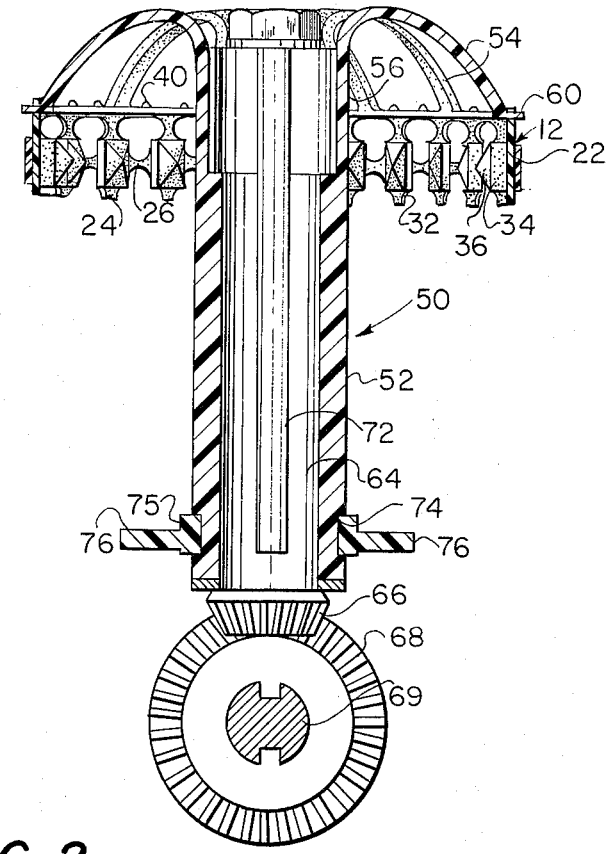
FIG. 2 is a sectional view taken along line 2—2 of FIG. 1 and including part of the type drum driving mechanism.
Figure 4:
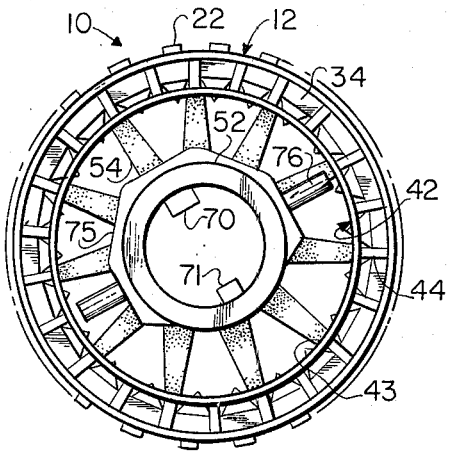
FIG. 4 is a bottom view of the type drum of FIG. 1.

As can be seen in FIGS. 1, 2 and 4, the shell 12 is formed of an open network of rows and columns wherein adjacent rows 14, 16, 18 and 20 are joined together by relatively resilient bridging connectors 26 and adjacent columns 24 are joined together by relatively resilient bridging connectors 28.

As here embodied, the shell 12 is formed as an integral molded structure with the type characters 22 molded thereon as an integral part of the shell. The type characters 22 are molded onto base sections 30 formed at the intersection of the rows and columns with the base section 30 and the bridging connectors 26, 28 defining open spaces such as cruciform apertures 32. While it is not necessary that every base section 30 have a type character formed thereon, in the embodiment illustrated in the drawing a type character does appear on each base section 30. This particular configuration provides an extremely light drum 10 which is highly flexible in a radial direction and relatively rigid in an axial direction.

Figure 5:
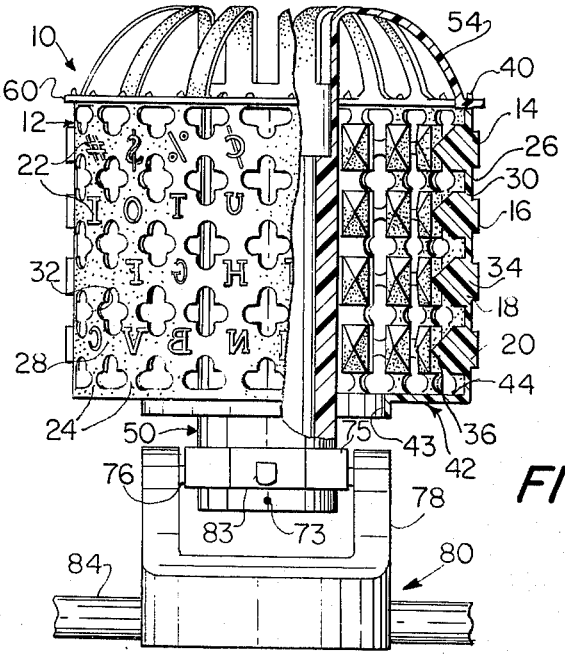
FIG. 5 is a partial sectional view of the type drum of FIG. 1.

As can be seen in FIGS. 2, 4 and 5, a preferred form of type drum shell 12 is provided with a radially inwardly extending projection or slug 34 behind each type character 22. The slug 34 preferably is molded as an integral part of the shell 12 and is shaped to have a tapered portion 36 at its radially inward most end. The tapered portion 36 can be pyramidal in shape. The slug 34 serves as an anvil against which a hammer impacts when a particular character is to be typed. The hammer and its method of operation are disclosed in the above referred to copending patent applications.

A series of circumferentially spaced extensions 40 project in an axial direction from one end of the shell 12. The other end of the shell 12, best seen in FIG. 5, is provided with an inwardly extending annular flange 42. Preferably the flange is formed of an annular rim 43 spaced inwardly from the main body of the shell and connected thereto by a series of spaced apart spokes 44. The spokes 44 preferably are located between adjacent columns 24.

Figure 3:
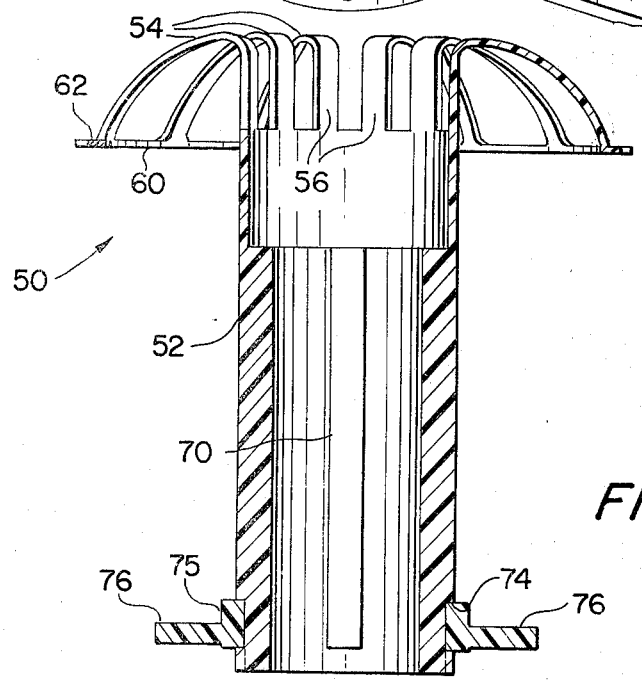
FIG. 3 is a sectional view of the hub portion of the drum.

In accordance with the invention, the type drum further includes a hub within the shell 12 and spaced therefrom, the hub having means for mounting the drum on a drum support and connecting means attaching the hub to the shell. As is best illustrated in FIG. 2 and 3, the hub 50 includes a cylindrical and hollow shaft 52 formed at one end with a plurality of equally, circumferentially spaced struts 54 which serve as the means for connecting the shell to the hub. As here embodied the struts are thin and flexible and are provided with a particular configuration designed to permit radial movement of the shell 12 with respect to the shaft portion 52 of the hub 50 and to preclude axial movement of the shell 12 with respect to the shaft 52 during normal use of the typewriter on which the drum is used.

In order to provide the axial rigidity desired the struts should be oriented as close to parallel to the axis as possible. It is also desired to space the shell from the hub to permit the location of a hammer and other operating elements therebetween. A still further consideration in designing the struts 54 is the need to keep the strut profile low and the struts separated so that the struts do not interfere with the line of sight between the typewriter operator and portion of the paper being typed upon. The strut design shown in the figures and described below accomplish the functional aspects desired.

Each strut 54 is provided with an axially directed base 56 which extends upwardly from the hub shaft 52 and then the strut curves outwardly from the strut base 56 and downwardly toward the other end of the hub 50. The struts 54 are tapered so that the end remote from the strut base 56 is considerably narrower than the base portion 56. This tapered configuration is to prevent the struts from interfering with the radial flexibility of the shell 12 to which the hub is attached while ensuring proper attachment of the struts 54 to the shaft 52 of the hub 50 in a manner which will facilitate manufacturing the hub, preferably by molding. The downward curvature of the struts 54 provides an axially directed structural component which provides the desired rigidity in the axial direction described above. The struts 54 are equally spaced apart and, in the preferred form shown in the drawings, are equal in number to one-half the number of columns 24 of the shell 12.

The struts 54 terminate in an annular rim 60 which is formed with a plurality of circumferentially spaced apertures 62. The struts 54 join the rim 60 at positions equidistant between adjacent apertures 62. The apertures 62 are designed to receive the extensions 40 of the shell 12. The extensions 40 together with the rim 60 serve to interconnect the shell and hub. It has been found that one strut 54 between alternating pairs of apertures 62 provides sufficient connection between the shell and hub without interfering with the radial flexibility of the shell 12 and the operator line of sight.

The hub shaft 52 is designed to receive rotatable driving means and means for moving the drum in an axial direction, the two motions in combination serving to locate a particular character at a predetermined print point with respect to the typewriter.

As here embodied the hub shaft 52 is formed as a hollow cylindrical member adapted to receive a drive shaft 64 which is attached at its lower end to a bevel gear 66 which meshes with a second bevel gear 68. The second bevel gear 68 is mounted on a driving shaft 69 which, through means described in the aforementioned copending applications, is driven particular angular amounts in response to the depression of particular typewriter keys.

The hub 50 and drive shaft 64 are prevented from having relative rotational motion with respect to each other. One construction which will prevent such relative motion and which will permit the type drum 10 to be mounted and removed easily from the drive shaft 64 is through the use of a key and a keyway. In the embodiment illustrated, the hub shaft 52 is provided with a pair of diametrically opposed longitudinal keys 70, 71 parallel to the hub shaft axis and the drive shaft 64 is provided with a pair of mating keyways, one of which is shown at 72. In order to ensure that the type drum 10 is always mounted on the drive shaft 64 with the same orientation so that depression of a particular key will always result in the selection and alignment of the corresponding character at a predetermined fixed point for typing, the keys 70, 71 and their corresponding keyways, are formed of different widths (see FIG. 4). In this manner only one particular orientation of the drum 10 will enable the drum to slide downwardly over the drive shaft 64. To simplify properly orienting the drum 10 on the drive shaft 64, indicia, such as a red dot 73, is provided on the hub shaft 52. Facing the dot 73 toward the front of the typewriter effects proper alignment of the keys and keyways.

An annular groove 74 is provided in the hub shaft 52 adjacent to the end opposite the struts 54 and a sleeve 75 is rotatably mounted therein. The groove 74 may be provided by forming it as part of the hub shaft 52 such as by molding it therein during the formation of the shaft 52. Alternatively, it can be formed by an annular sub ring which is fixedly attached. such as by solvent welding, to a recessed portion of the hub shaft to form an annular groove. The sleeve 75 is provided with a pair of radially outwardly extending attachment means or projections 76. At least one arm and, preferably, a pair of arms 78 forming a yoke 80 are mounted on the typewriter on opposite sides of the type drum and include slots 82 adapted to receive the projections 76. Indicia, such as a protuberance 83 molded on the sleeve 75, is provided to simplify proper alignment of the sleeve 75 and hub shaft 52 for mounting on the typewriter. In order to mount the drum 10 on the drive shaft 64 and the yoke 80, the protuberance 83 must be aligned with the red dot 73.

The yoke 80 is mounted on a horizontally oriented shaft 84 which is driven in response to operation of the typewriter keys through means described in the aforementioned copending applications in a manner that, depending upon the particular key depressed, the yoke shaft 84 will rotate a particular amount causing the yoke to pivot upwardly an amount preset to align one of the rows 14, 16, 18, 20 with the predetermined fixed print point. Because the sleeve 75 is rotatably mounted on the hub shaft 52, the hub can be rotated by the drive shaft 64 relative to the sleeve and the yoke 80.

The entire hub 50 including the rim 60 preferably is molded as a single integral member of relatively flexible plastic. Similarly, the entire shell 12 preferably is molded as a single integral member of relatively flexible plastic. It has been found that acetal resins are particularly suitable for both the hub and shell, one such resin being known as Delrin manufactured by E. I. duPont De Nemours and Co.

In assembling the hub 50 and shell 12 together to form the type drum 10, the shell is fitted over the hub and the shell projections 40 are inserted into the apertures 62 in the hub rim 60. The shell and hub are then united by any suitable means such as through the use of a suitable adhesive, solvent welding, thermal welding or mechanical deformation of the projections 40, such as peening.

In order to assist the typist in locating the type drum in a particular position two pointers, one of which is shown at 86, are provided on top of the shell 12 at diametrically opposed positions. One way to form the pointers is to not fully deform two of the projections 40, and allow the projections to serve as pointers as can be seen in FIG. 1.

Figure 6:
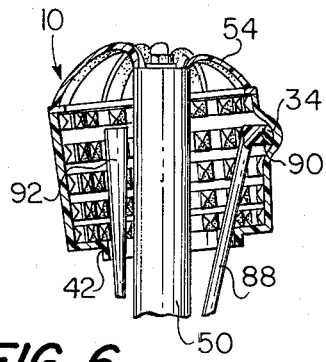
FIG. 6 is a schematic illustration illustrating the general position of the type head of FIG. 1 at the instant of printing.

As is described in the afore-described copending applications, depression of a key on a typewriter effects rotation and elevation of the drum 10 an amount necessary to locate the corresponding type character 22 at a printing point. At that moment a hammer 88 (FIG. 6) located between the hub 50 and shell 12 is moved toward the shell and strikes the slug 34 corresponding to the selected character which causes the shell to move radially pressing the selected character against a typewriter ribbon (not shown) to produce a print of that character on paper. FIG. 6 is a schematic illustration showing the general position, in exaggerated form, of the the type drum at the instant of printing. The hammer 88 has an indented face 90 to receive the tapered portion 36 of the slug 34. The hammer is mounted on the typewriter in a manner to assure that the hammer will always accurately move to a position aligned with and spaced radially from the predetermined print point. Since the drum shell 12 is able to be moved relative to the hub 50, the hammer 88, while receiving the tapered slug 34, accurately aligns the selected type character with the print point and consistently forces the selected type character to produce its print at the print point.

As can be seen in FIG. 6, the movement of the drum shell 12 relative to the drum hub 50 is a complex combination of pivoting each strut 54 about a horizontal axis at the top of its strut base 56 and radially deforming the portion of the shell 12 in the vicinity of the selected type character 22. Since the rows 14, 16, 18, 20 of type character 22 are located at different distances from the top of the strut bases 56 (the pivoting axes) the lower row 20 tends to move radially further than the upper row 14 which could produce different printing impressions for the different rows. In order to equalize the impressions, a post 92 is fixedly mounted on the typewriter between the drum shell 12 and hub 50 and on the side of the hub opposite the hammer 88. The post 92 is tapered or inclined so that its surface 94 facing the shell 12 is further from the hub 50 near the top of the post 92 then it is near the base of the post. In other words, as the type drum 10 is raised to align the selected type character, the clearance between the post 92 and shell flange 42 becomes less in order to equalize the pivoting movement of the shell 12 about the top of the strut base 56 and thereby equalize the printing impression. As the hammer 88 forces the shell 12 toward the paper, the shell flange 42 abuts the post 92 restricting the extent of pivoting movement of the shell 12.

A type drum formed in accordance with the above disclosure can be manufactured easily of three parts, namely a shell 12, hub 50 and sleeve 75, all of which are molded on plastic and easily assembled. If it is desired to use the assembly including a sub ring on the hub shaft to form the annular groove 75, then four parts are required. The resulting type drum is light and can be easily and accurately operated with a minor number of parts.

What is claimed is:

1. A type drum comprising:

a cylindrical shell having a plurality of circumferential rows spaced apart axially, each of said rows having a plurality of circumferentially spaced apart type characters on the exterior surface thereof;

a hub within said shell and spaced therefrom, said hub having first means for mounting said drum on a drum support; and second means connecting said shell to said hub, said second means being resilient and flexible in a direction transverse to the longitudinal axis of said shell enabling movement of the entire shell relative to said hub in a direction transverse to the longitudinal axis of said shell, and means for applying a force in the transverse direction causing said second means and said entire shell to move in the transverse direction.

2. A type drum as defined in claim 1 wherein each of said rows comprises a plurality of circumferentially spaced base sections, each of said base sections having one of said type characters thereon, and relatively resilient first bridging connectors joining said base sections to form said rows.

3. A type drum as defined in claim 2 wherein adjacent rows are joined together by relatively resilient second bridging connectors.

4. A type drum as defined in claim 1 wherein each of said rows comprises a plurality of circumferentially spaced base sections, each of said base sections having one of said type characters thereon and being joined to an adjacent base section in the same row by resilient first bridging connectors and being joined to an adjacent base section in an adjacent row by resilient second bridging connectors, said first bridging connectors of each row being spaced apart axially from said first bridging connectors of an adjacent row and having apertures therebetween and said second bridging connectors being spaced apart circumferentially from an adjacent second bridging connector and having apertures therebetween.

5. In combination, a type drum comprising a cylindrical shell formed of an open network formed by a plurality of axially spaced apart circumferential rows and a plurality of circumferentially spaced apart resilient longitudinal columns intersecting said rows, a type character being located on at least the majority of the intersections of said rows and said columns, and apertures through said shell between adjacent rows and columns for enabling a single type character to be deflected relative to adjacent type characters, a hub within said shell and spaced therefrom, said hub having means for mounting said drum on a drum support, and connecting means attaching said shell and said hub in order that the entire shell moves relative to said hub in a direction generally transverse to the longitudinal axis of said shell when said shell is subjected to a transverse force, and means for applying said transverse force to said shell causing a single type character to deflect relative to adjacent type characters and causing said shell to move relative to said hub in a direction generally transverse to the longitudinal axis of said shell.

6. A type drum as defined in claim 5 including an annular flange extending inwardly from one end of said shell toward the axis of the shell.

7. A type drum as defined in claim 5 including an extension spaced from the mounting means projecting from said shell to serve as an indicator of position of the type drum in connection with the typewriter in which the drum is used, said indicator being visually observable to the operator of the typewriter when said drum is mounted on a typewriter.

8. A type drum as defined in claim 5 wherein said shell is an integral molded structure having the type characters molded thereon.

9. A type drum as defined in claim 5 wherein said connecting means is a plurality of circumferentially spaced struts attached at one end to said hub and at the other end to said shell.

10. A type drum as defined in claim 9 wherein said other end of the struts is attached to one end of the shell.

11. A type drum as defined in claim 10 wherein said struts extend outwardly from said hub and downwardly such that said other end of a plurality of said struts has a component parallel to the axis of said shell to provide axial rigidity to said drum by retarding axial movement of said shell relative to said hub.

12. A type drum as defined in claim 10 wherein the struts are tapered so that the said one end of said struts is wider than said other end of said struts.

13. A type drum as defined in claim 10 including a rim attached to said one end of the shell, said other end of the struts being attached to said rim.

14. A type drum as defined in claim 13 wherein said hub, struts and rim are formed as a single first integral member and wherein said shell is formed as a single second integral member.

15. A type drum as defined in claim 14 wherein said one end of said shell has a plurality of circumferentially spaced extensions and wherein said rim includes a plurality of circumferentially spaced apertures adapted to receive said extensions for attaching said rim to said shell.

16. A type drum as defined in claim 15 wherein said other end of said struts is located between and equidistant from adjacent apertures.

17. A type drum as defined in claim 5 wherein said connecting means substantially prevents axial movement of said shell relative to said hub and permits radial and pivotal movement of said shell relative to said hub.

18. A type drum as defined in claim 17 wherein said connecting means is a plurality of circumferentially spaced struts attached at one end to said hub and at the other end to said shell, said struts decreasing in cross-sectional area from said one end toward said other end.

19. A type drum as defined in claim 18, wherein said struts are attached to one end of said shell and including an annular flange extending inwardly toward the axis of the shell from the other end of the shell.

20. A type drum as defined in claim 17 including a projection extending inwardly toward the axis of said shell from each of said intersections having a type character, each projection having a tapered portion at its radially inwardmost end.

21. In combination, a type drum comprising a cylindrical shell having a plurality of circumferential rows spaced apart axially, each of said rows having a plurality of circumferentially spaced apart characters on the exterior surface thereof, a hub within said shell and spaced therefrom, means connecting said shell to said hub enabling movement of the entire shell relative to said hub in a direction transverse to the longitudinal axis of said shell, mounting means rotatably supported on said hub and having attachment means thereon, drum support means adapted to releaseably engage said attachment means to effect mounting of said drum on said support means enabling said drum to rotate relative to said support means and means for applying a force in a direction transverse to the longitudinal axis of said shell causing said entire shell to move in the transverse direction relative to said hub.

22. The combination of claim 21 wherein said mounting means is a sleeve, wherein said attachment means includes a projection extending outwardly from said sleeve and wherein said support means includes an arm having a slot therein to receive said projection.

23. The combination of claim 22 wherein said hub is hollow and is adapted to receive rotatable driving means and including means for preventing relative rotation between said hub and said driving means, said driving means effecting rotational movement of said drum about the longitudinal axis thereof and said arm effecting axial movement of said drum so that each of said characters may be selectively aligned with a predetermined fixed point.

24. The combination of claim 23 wherein said shell is an open network of a plurality of axially spaced apart circumferential rows and a plurality of circumferentially spaced apart axial columns intersecting said rows, a type character being located on substantially each intersection of said rows and said columns.

25. The combination of claim 24 wherein said means connecting said shell to said hub is a plurality of circumferentially spaced struts attached at one end to one end of said hub and at the other end to one end of said shell, said mounting means being supported on said hub adjacent to the other end of said hub.

26. The combination of claim 25 including means for equalizing the radial movement of said shell relative to said hub during movement of said type characters toward said fixed point.

27. The combination of claim 26 wherein the equalizing means includes an annular flange extending inwardly toward the axis of the shell from the other end of said shell.

28. The combination of claim 27 wherein the equalizing means further includes a rigid member between said hub and said flange, said rigid member being shaped so that as said drum is moved axially, the clearance between said annular flange and said rigid member varies.

29. The combination of claim 21 wherein said hub is hollow and is adapted to receive rotatable driving means and including means for preventing relative rotation between said hub and said driving means.

30. The combination of claim 29 wherein the relative rotation preventing means is a key on one of said hub and said driving means and a keyway on the other of said hub and said driving means and including means for enabling said drum to be placed on said driving means in only one alignment with respect to said driving means.

31. In combination, a type drum comprising a cylindrical shell formed of an open network formed by a plurality of axially spaced apart resilient circumferential rows and a plurality of circumferentially spaced apart resilient longitudinal columns intersecting said rows, a base section having a type character on the exterior surface thereof being located on at least the majority of the intersections of said rows and said columns, each of said base sections being joined to an adjacent base section in the same row by resilient first bridging connectors and being joined to an adjacent base section in an adjacent row by resilient second bridging connectors, said first bridging connectors of each row being spaced apart axially from said first bridging connectors of an adjacent row and having apertures therebetween and said second bridging connectors being spaced apart circumferentially from an adjacent second bridging connector and having apertures therebetween, a hub within said shell and spaced therefrom, said hub having means for mounting said drum on a drum support, connecting means attaching said shell and said hub in order that the entire shell moves relative to said hub and the drum mounting means in a direction generally transverse to the longitudinal axis of said shell when said shell is subjected to a transverse force, and means for applying said transverse force to a base section of said shell causing every bridging connector to move generally in the direction of said force effecting a single type character to deflect relative to adjacent type characters and causing the entire shell to move relative to said hub and the drum mounting means in a direction generally transverse to the longitudinal axis of said shell.

32. A type drum as defined in claim 31 including a tapered projection extending inwardly toward the axis of said shell from each of said intersections carrying a type character, said projection being adapted to mate with the transverse force applying means to accurately position said single type character through flexing of the bridging connectors connected to the base section of said single type characters.

33. In combination, a type drum comprising a cylindrical shell formed of an open network formed by a plurality of axially spaced apart resilient circumferential rows and a plurality of circumferentially spaced apart resilient longitudinal columns intersecting said rows, base sections having a type character on the exterior surface thereof being located on at least the majority of the intersections of said rows and said columns, each of said base sections being joined to an adjacent base section in the same row by resilient first bridging connectors and being joined to an adjacent base section in an adjacent row by resilient second bridging connectors, said first bridging connectors of each row being spaced apart axially from said first bridging connectors of an adjacent row and having apertures therebetween and said second bridging connectors being spaced apart circumferentially from an adjacent second bridging connector and having apertures therebetween, a hub within said shell and spaced therefrom, said hub having means for mounting said drum on a drum support, connecting means attaching said shell and said hub in order that the entire shell moves relative to said hub and the drum mounting means in a direction generally transverse to the longitudinal axis of said shell when said shell is subjected to a transverse force, print impression equalizing means adapted to forceably contact a portion of said shell when said shell is subject to said transverse force, and means for applying said transverse force to a selected base section of said shell causing every bridging connector to move generally in the direction of said force effecting a single type character to deflect to adjacent type characters and causing the entire shell to move relative to said hub and the drum mounting means in a direction generally transverse to the longitudinal axis of said shell in order to cause every selected type character to apply equal force on a record medium regardless of location on said shell.

* * * * *